US005713439A

United States Patent [19]

Zionts et al.

[11] Patent Number: 5,713,439

[45] Date of Patent: Feb. 3, 1998

[54] DUAL POINT AUXILIARY LUGGAGE ATTACHMENT SYSTEM

[75] Inventors: Andrew Lewis Zionts; Agnes Csilla Domotor, both of Providence; Mark T. Salander, Barrington, all of R.I.

[73] Assignee: Samsonite Corporation, Denver, Colo.

[21] Appl. No.: 599,918

[22] Filed: Feb. 12, 1996

[51] Int. Cl.[6] ..... A45C 5/14; A45C 13/28; A45C 13/30; A45C 13/38

[52] U.S. Cl. ..... 190/102; 190/18 A; 190/108; 150/108; 150/111

[58] Field of Search ..... 190/102, 108, 190/110, 18 A; 150/108, 109, 111; 343/37

[56] References Cited

U.S. PATENT DOCUMENTS

| | | | |
|---|---|---|---|
| 2,960,137 | 11/1960 | Lipsitz | 150/108 X |
| 4,153,092 | 5/1979 | Haslam | 150/108 |
| 4,170,282 | 10/1979 | Schwartzstein | 190/108 X |
| 4,206,835 | 6/1980 | Shapiro | 190/108 |
| 4,424,841 | 1/1984 | Smith | 190/108 X |
| 4,442,960 | 4/1984 | Vetter | 190/108 X |
| 4,884,731 | 12/1989 | Sibley | 383/2 |
| 5,240,106 | 8/1993 | Plath | 190/102 X |
| 5,318,084 | 6/1994 | Jackson | 150/109 |
| 5,431,262 | 7/1995 | Rekuc et al. | 190/102 X |
| 5,547,052 | 8/1996 | Latshaw | 190/102 X |

FOREIGN PATENT DOCUMENTS

| | | | |
|---|---|---|---|
| 2358124 | 2/1978 | France | 190/102 |
| 12928 | of 1911 | United Kingdom | 150/111 |
| 2224490 | 5/1990 | United Kingdom | 190/108 |

*Primary Examiner*—Sue A. Weaver

*Attorney, Agent, or Firm*—Rod D. Baker; Gregory W. O'Connor

[57] ABSTRACT

The invention relates to an apparatus for attaching auxiliary items of luggage to a main luggage case, especially a wheeled main luggage case. The apparatus consists in part of a strap which ordinarily accompanies the auxiliary luggage item. The strap, which consists in part of two belts that may be moved past each other to adjust the length of the strap, is attached to the main luggage case at dual separate points in order to improve the stability of the attachment of the auxiliary item to the main luggage case. The strap may be disengaged from the main luggage case and used as a shoulder strap solely in conjunction with the auxiliary item to carry the auxiliary item over the user's shoulder.

23 Claims, 5 Drawing Sheets

DUAL POINT AUXILIARY LUGGAGE ATTACHMENT SYSTEM

BACKGROUND OF THE INVENTION

1. Field of the Invention

The invention relates generally to an apparatus for attaching items to the exterior of luggage cases, and more particularly to an improved system for attaching an item of auxiliary baggage to a main luggage case, whereby the attachment system serves also as an optional shoulder strap system for the auxiliary item of baggage.

2. Background Art

It is conventional in luggage manufacturing to provide luggage with a carry handle of some sort with which to lift and carry the case. Long straps are known to be used in lieu of or in addition to carry handles to allow the luggage user more easily to tote the case by placing the strap across a shoulder. The weight and bulk of the case are thus carried directly upon the shoulder or back.

Additionally, it is known in the art to provide devices allowing an auxiliary item of luggage to be temporarily hooked or otherwise attached upon a wheeled article of luggage, thereby allowing the wheeled luggage to serve as a cart or dolly for the auxiliary item. The main article of wheeled luggage typically is equipped with a single extendable belt with one end free and the other end permanently attached to the main article of luggage. The free end of the belt is wrapped around a handle of the auxiliary article, and then connected to the main luggage case to secure the two pieces of luggage together. An alternative manifestation of the idea is the securing of a rigid hook to the free end of the belt, and then hanging the auxiliary item from the hook, thereby dangling the auxiliary item from the main case. Also, it is known to mount a rigid hook directly upon the exterior of the main case. However, these commonly encountered versions of simple auxiliary luggage attachment systems lack the security and stability often demanded by the modern traveler. Auxiliary items of luggage may be lost or stolen when they are lifted off dangling hooks. Auxiliary luggage may fall off an open hook on the end of a freely swinging belt.

A sophisticated manner of providing an auxiliary luggage attachment is disclosed in U.S. Pat. No. 4,759,431, assigned to the assignee of the present application. The '431 patent describes a travel bag with a combination pull handle and auxiliary bag belt. A modular pull handle is fashioned to be incorporated into a wheeled piece of luggage, so that the handle can be extended for rolling movement of the luggage across a supporting surface. The handle unit also provides a system for controlling the belt which is adapted to secure auxiliary pieces of luggage to the wheeled piece of luggage. In several embodiments, the belt is incorporated into the handle and the assembly is designed to maintain the belt in a ready, deployable position upon extension of the handle assembly. The belt, upon being extended away from the handle, is automatically biased into its retracted position so that upon completion of its use, it is easily returned to its position within the handle assembly.

In all the known examples of auxiliary attachment systems, however, the attachment belt, if any, is adapted solely for use as a component for connecting auxiliary luggage to a main wheeled case. Consequently, its absolute length—which in many embodiments is invariable—is adapted to that particular purpose. The belt's length, or its strength, or its manner of attachment to the main case preclude usefulness as a carry strap.

The present invention improves upon the foregoing background art by permitting the user alternatively to use a single strap either as a shoulder or carry strap for an auxiliary item of luggage, or as a means for attaching the auxiliary item to the main luggage case. Because the adjustment may need to be accomplished in a bustling passenger train terminal, for example, or in a hurried rush to an airport baggage check, practical dual use requires strap length to be quickly adjustable, and that an end of the strap be rapidly disconnected/reconnected to the main case. The applicant is unaware of previous instances in the art where a shoulder strap is particularly adapted for practical alternative use for auxiliary luggage attachment.

Accordingly, a need remains for a luggage strap that may be used to carry an auxiliary item of luggage upon the shoulder, but alternatively may be used to temporarily attach the auxiliary item (such as a briefcase, beauty case, small bag, or the like, to the main item of luggage. Furthermore, a need remains for an auxiliary luggage strap attachment system that more securely attaches the auxiliary item to the main case to prevent it from swinging about, hanging to one side of the main case, or falling off. Against the foregoing background, and to overcome the unmet needs identified with the prior art, the present invention was developed.

SUMMARY OF THE INVENTION

The invention relates generally to a strap assembly apparatus alternatively for attaching an auxiliary item of luggage to a main luggage case or for carrying the auxiliary item of luggage on the user's shoulder. In one embodiment, the assembly includes two belts disposed through a shoulder pad, glide means permanently fixed upon a first end of each belt and slidably disposed upon the opposite belt, loop means upon the auxiliary item and the belts slidably disposed through the loop means, and means for attaching the second ends of the belts to different locations on the main case, whereby the strap assembly is connected to the auxiliary item of luggage by the loop means, and the complete strap assembly is releasably attached to the main case at dual attachment points. A preferred means for attaching the second ends of the belts to distinct sides of the main case is disclosed, comprising at least a pair of receptacles mounted upon the main luggage case, and hooks securely attached to the second ends of the belts, whereby the hooks are engageable with the receptacles. The hooks also function to prevent the belts from slipping entirely through the loop means, and thereby allow the strap assembly to suspend the auxiliary item of luggage from a user's shoulder. The loop means slidably disposed upon the belts preferably are swivel clips.

A primary object of the invention is to provide an apparatus which alternatively and optionally may be used either as an auxiliary luggage shoulder strap or as a device for attaching the auxiliary luggage to a main luggage case.

A primary advantage of the invention is that it is simple and inexpensive.

Another advantage of the invention is that when used to attach an auxiliary item of luggage to a main luggage case, the invention provides a secure and stable attachment.

Another advantage of the invention is that it allows an auxiliary item of luggage to remain attached to a main luggage case even when the main luggage case is in an unattended, upright position.

Another advantage of the invention is that it allows the position of the auxiliary item of luggage to be adjusted relative to the main luggage case to improve stability and reduce the amount of weight borne by the user's arm when the main luggage case is wheeled across a supporting surface.

Other objects, advantages and novel features, and further scope of application of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention, and together with the written description serve to explain the principles of the invention. The drawings are only for the purpose of illustrating a preferred embodiment of the invention and are not to be construed as limiting the invention. In the drawings.

DESCRIPTION OF THE PREFERRED EMBODIMENT (BEST MODE FOR PRACTICING THE INVENTION)

The invention relates to apparatuses for attaching auxiliary items of luggage to a main luggage case, especially a wheeled vertical or "upright" case. The apparatus of the invention allows the user to secure an auxiliary item to a main piece of wheeled luggage in a manner that is more secure and stable than items known to the art. The apparatus has an advantage of including a strap that alternatively may be used to carry the auxiliary item of luggage over the user's shoulder.

Figure 1:
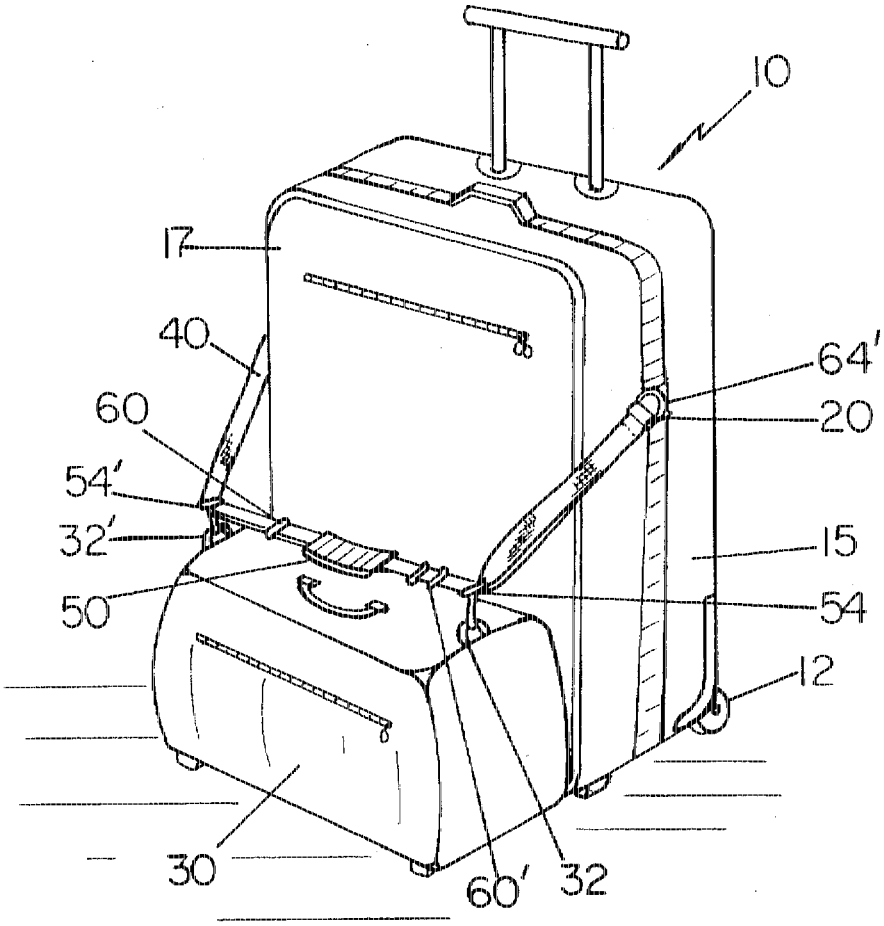
FIG. 1 is a perspective view of a preferred embodiment of the invention employed in conjunction with a main luggage case and an auxiliary item of luggage.
Figure 2:
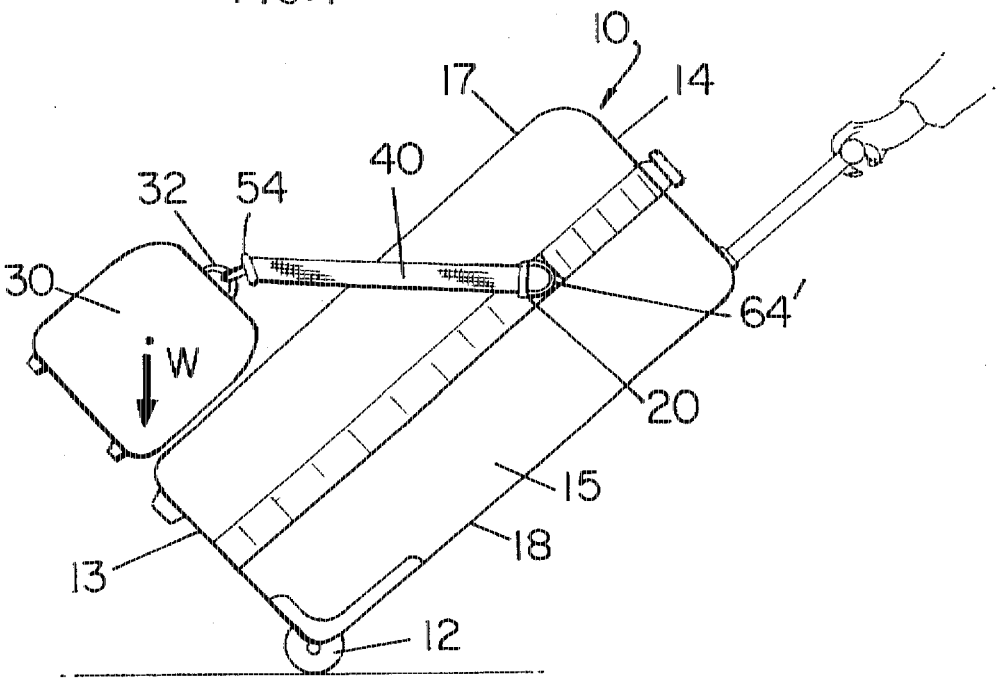
FIG. 2 is a right side view of the FIG. 1 embodiment, with the main luggage case tipped into position to be moved by a user.

FIGS. 1 and 2, illustrate that the invention is intended to be used primarily in conjunction with a main luggage case 10. The invention consists in part of various attachments and accessories usable with the main luggage case 10 and the auxiliary item of luggage 30 to attach the auxiliary item 30 to he main luggage case 10. Main luggage case 10 is any of the upright wheeled luggage cases known in the art, and practically any type of upright case may be equipped with the invention and adapted to benefit from its advantages. Main case 10 may be either hard-sided or soft-sided, and may have any number of wheels 12, 12' mounted upon its bottom 13. Bottom 13, top 14, right side 15 and left side 16, front 17 and back 18 define main case 10, conventionally as a rectangular parallelepiped containing an interior space where clothing, personal items and the like are placed for storage and transport. In a soft-sided version of the preferred embodiment of the invention, both sides 15, 16 will overlay or incorporate a rigid structural frame member (not shown).

The preferred embodiment of the invention includes a strap member 40 releasably attachable to main case 10. As shown in FIGS. 1 and 2, strap member 40 is used to attach the auxiliary luggage item 30 to the main case 10. Auxiliary item 30 may be a small bag or attache case. Auxiliary item 30 is provided with one or more protruding fabric loops, loops of nylon webbing, or the like, or preferably wire D-rings 32, 32'. The rings 32, 32' are at any location upon the top of the auxiliary item 30, preferably one at each end as shown in the Figures. Strap 40 is releasably connected to the D-rings 32, 32' by means of corresponding swivel hook clips 54, 54' slidably disposed upon strap member 40 and releasably clipped to the D-rings 32, 32'. A shoulder pad 50 is centrally placed upon strap member 40.

Figure 3:
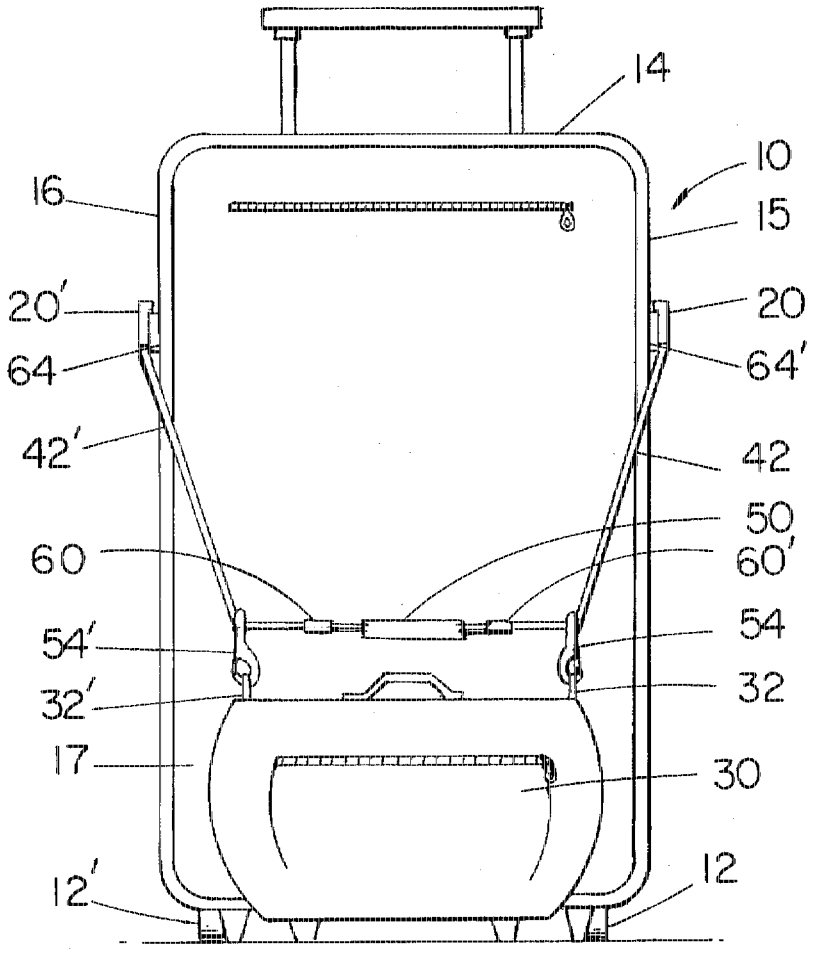
FIG. 3 is a front view of the FIG. 1 embodiment.

Reference is made to FIGS. 1–3, which show that the two ends of strap member 40 connect to the sides 15, 16 of the main case 10 by way of a pair of disk hooks 20, 20' and disk receptacles 64, 64'. The inventive apparatus allows the auxiliary item 30 to be releasably attached to the main case 10 an a secure manner. As shown in FIGS. 1 and 3, the auxiliary item 30 is attached to the case 10 not by means of one strap with a free end dangling from a single central location upon case 10, as is common in the art, but rather by means of a strap 40 that is suspended from two separate laterally placed anchor points. The strap is prevented from swinging like a free pendulum; as a result, when the main case is tipped and wheeled by the user, as shown in FIG. 2, the auxiliary item 30 rides centrally and stably upon the front 17 of case 10 and is less apt to swing over to a side 15, 16 of case 10. Also, the inventive apparatus comprising two separated attachment points upon the case 10, and the use of a pair of reliable swivel hook clips 54, 54' snapped upon D-rings 32, 32' offers added security against inadvertent removal of auxiliary item 30. Also, it will be appreciated that the auxiliary item 30 when attached to the case 10 in the relationship shown in FIGS. 1 and 2, may serve as a sort of shelf or ledge upon which additional items of luggage may be stacked for transport.

In the preferred embodiment, strap member 40 is comprised of two conjoined belts 42, 42' that are partially overlapped and slidable against each other. Because the parallel belts 42, 42' can slip past one another to lengthen or shorten the overlapping portions of their respective lengths, the overall effective length of strap 40 is adjustable by sliding glides 60, 60' along belts 42, 42'. The invention permits the length of strap member 40 to be easily and rapidly adjusted, and yet provides that the shoulder pad 50 will nearly always remain centrally disposed upon strap member 40. The belts 42, 42' slide past each other, inward toward or outward away from the shoulder pad 50, so that pad 50 remains generally in the center of the strap 40 regardless of the strap's adjusted length.

As suggested in FIGS. 1 and 3, strap 40 may be adjusted in length to provide that the auxiliary item 30 rests directly upon the floor or other supporting surface when main case 10 is placed in the fully upright (typically, but not necessarily, perpendicular) rest position. This offers an advantage. The main case 10 may be deposited in its upright rest position with the auxiliary item 30 attached thereto, without the main case 10 tipping over. In prior art systems, when the main case is placed in its upright rest position to be left unsupported by the user, the auxiliary case dangles from the front of the case but does not reach the floor. This usually causes a weight imbalance resulting in the main case tipping toward the auxiliary case and falling over to the floor. With the present invention, the connected combination of auxiliary case 30 and main case 10 may be stood upright and left unattended, without falling over, freeing both the user's hands to place a telephone call, check airplane tickets, or the like.

FIG. 2 illustrates that main case 10 may be tipped for wheeled movement. The user tows or pushes main case 10 across a supporting surface while the auxiliary item 30 rides along, connected to main case 10 by the strap member 40 which is releasably attached to both sides of the case 10. With the auxiliary case 30 attached to case 10 in the relative positions suggested by FIGS. 1–3, the wheels 12, 12' are generally between the user and the center of gravity (indicated by W in FIG. 2) of auxiliary case 30. This arrangement offers added user comfort while main case 10 is wheeled along, since the weight W of the auxiliary item 30 tends to counter-balance the weight of the main luggage case 10 (the center of gravity of which is between the user and the wheels 12, 12' in FIG. 2). In many prior art systems, the auxiliary item tends to ride higher upon the main case 10, which locates the centers of gravities of both cases between the wheels and the user, increasing the amount of weight carried by the user's arm. In the present invention, the total weight of the combined items of luggage is more evenly balanced over the wheels 12, 12', and comparatively more weight is born by the wheels than by the user's arm.

The strap member 40 with shoulder pad 50 may alternatively be used simply to carry the auxiliary item of luggage 30. Auxiliary item 30 may be removed from main case 10 by disengaging disk hooks 20, 20' from disk receptacles 64, 64', at which time strap member 40 ceases to function as a device for connecting the two items of luggage together. The swivel clips 54, 54', still hooked to the D-rings 32, 32', are slipped along the belts 42, 42' of the strap 40 until they encounter the disk hooks 20, 20' fixed at the ends of the strap 40. Disk hooks 20, 20' are too large to pass through the belt slot 59 (FIG.4) in the swivel clips 54, 54, which prevents the swivel clips from slipping off the ends of the strap member 40. With the swivel clips 54, 54' clipped to the D-rings 32, 32', and in contact with both disk hooks 20, 20', strap member 40 is configured for use as a shoulder strap. The user may adjust the length of strap member 40, if desired, by moving the glides 60, 60' along belts 42, 42'. The auxiliary item 30 may be picked up by the strap member 40, suspended by the D-rings 32, 32', and the shoulder pad 50 placed upon the user's shoulder, at which time the auxiliary item 30 carried upon the user's shoulder.

Figure 6B:
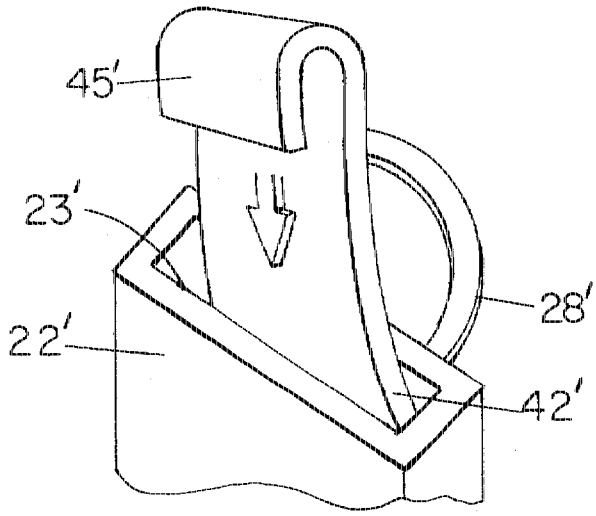
FIG. 6B is a detailed enlarged view of another portion of the strap member assembly of FIG. 6.
Figure 6:
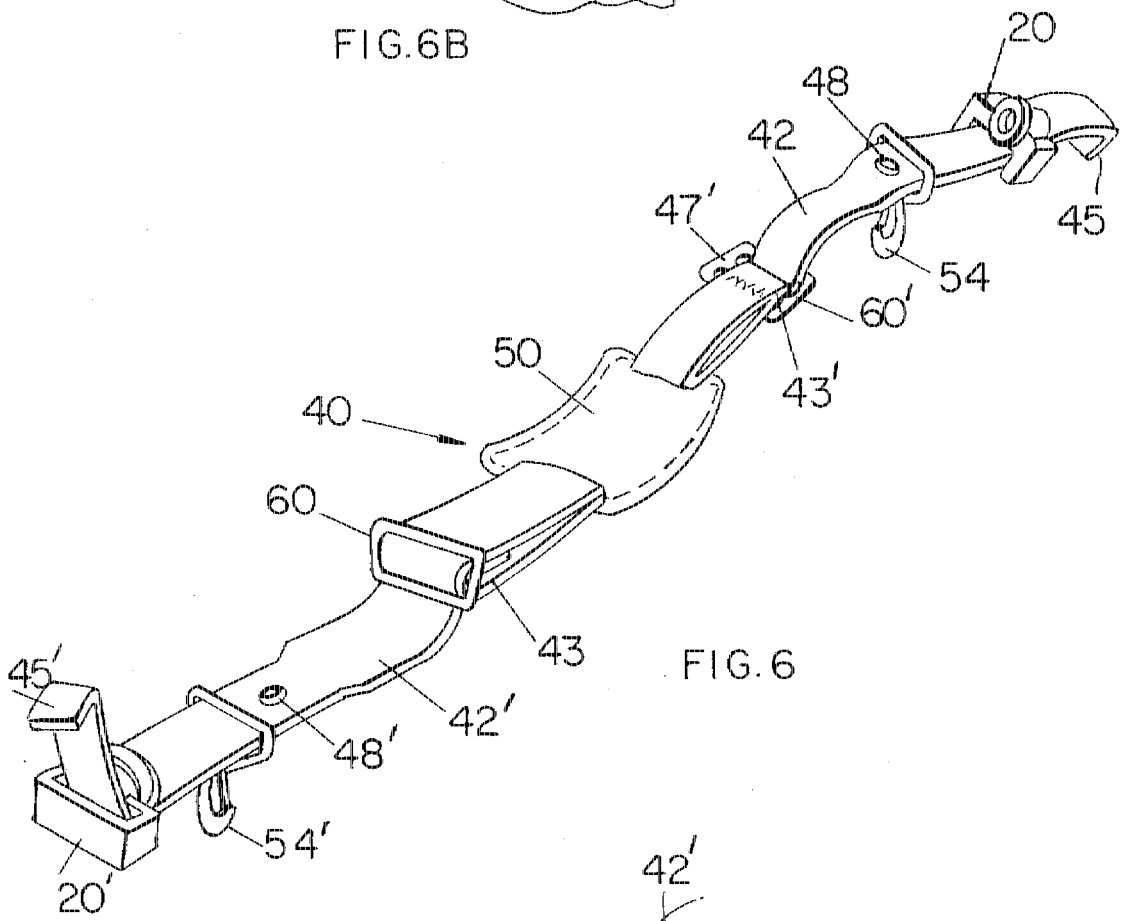
FIG. 6 is a perspective top view of a strap member assembly according to a preferred embodiment of the invention.
Figure 7:
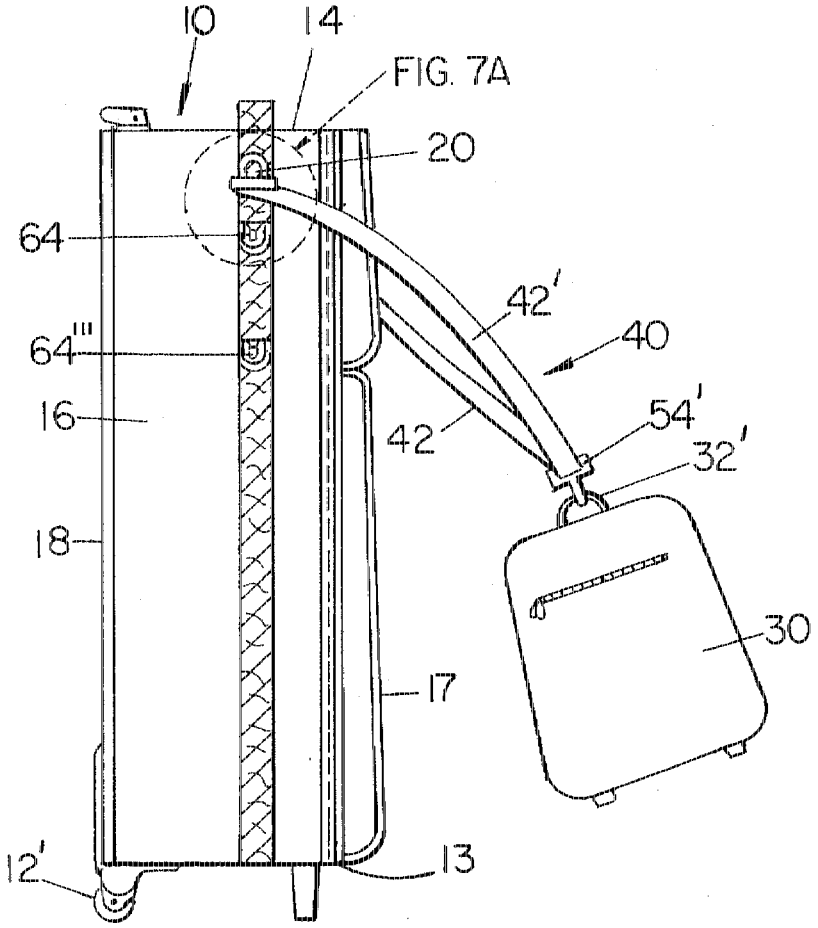
FIG. 7 is a left side view of the embodiment of FIG. 1, showing the auxiliary item of luggage about to be attached to the main luggage case according to the invention.

FIGS. 6 and 7 provide additional detail of the assembly of the strap member 40. Strap member 40 consists of two separate lengths of belt 42, 42', preferably fashioned from the heavy-duty, but attractive, woven webbing belt material common in the art. The two belts 42, 42' comprising strap member 40 are connected together using a pair of three-rung glides 60, 60' and a shoulder pad 50, as further explained herein. The overall length of strap 40 is adjustable due to the slidable disposition of the belts 42, 42' through respective glides 60, 60'.

Figure 6A:
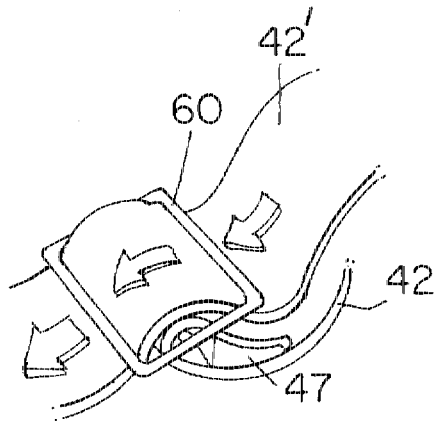
FIG. 6A is a detailed enlarged view of a portion of the strap member assembly of FIG. 6.

The complete strap system with associated hardware of the invention is depicted in FIG. 6. Description of the mode of assembly, with reference to FIGS. 6, 6A, and 6B, serves to describe a preferred embodiment of the strap system of the inventive apparatus. The two belts 42, 42' are cut to a desirable predetermined length, e.g. about 80 cm, depending upon the sizes of the cases 10, 30. Distal ends 43, 43' of each belt are looped around the center rung or "bar" of corresponding conventional three-bar glides 60, 60', doubled back, and securely sewn to permanently attach glides 60, 60' to the distal ends 43, 43' of the belts 42, 42'. A doubled-back, folded-over portion 47 of belt 42 thus occurs adjacent to glide 60, as shown in FIG. 6A, and a similar, but inverted configuration occurs at the distal 43' of the other belt 42' in the vincinity of the other glide 60'. In the preferred embodiment, double-headed rivets 48, 48' are fastened on-center upon each belt 42, 42' at a predetermined location along its length (e.g. about 55 cm from each distal end 43, 43'). Preferably, the thickest side of each rivet 48 occurs on the same side of each belt 42 as the folded-over portion 47 of that belt.

Shoulder pad 50 is generally typical of the art, and may be formed to comfortably ride upon the shoulder of the user when the auxiliary item of luggage 30 is being carried apart from the main case 10. Shoulder pad 50 has at least two layers (i.e. an interior layer and an exterior layer, the interior layer being the more padded and placed directly against the user's shoulder) joined together at portions of their perimeters in a manner known in the art. The exterior layer is provided with a pair of slits, as shown in FIG. 6, or the two layers may not be joined throughout their complete perimeters, in order to permit belts 42, 42' to be slipped through the pad 50, between the interior and exterior layers. With the exterior layer of the pad 50 facing up, the first belt 42 is slipped through the shoulder pad 50 with its folded-over portion 47 facing upwardly. The second belt 42' is also slipped through the pad 50, from the opposite direction and parallelly adjacent to first belt 42, except that its folded-over portion faces downward, all as suggested in FIG. 6.

Each of the proximate ends 45, 45' of belts 42, 42' (that is, each end not attached to one of three-bar glides 60, 60') is slidably passed through shoulder pad 50, and weaved through the slots of the glide 60, 60' attached to the other belt. The proximate end 45 of first belt 42 is weaved through the slots of glide 60' attached to the distal end 43' of the second belt 42', and the proximate end 45' of the second belt 42' is weaved through the glide 60 attached to the distal end 43 of the first belt 42. FIG. 6A provides a more detailed view of how second belt 42' passes through glide 60 (as indicated by directional arrows), and how first belt 42 is wrapped around the center bar of glide 60 to create folded-over and sewn portion 47.

Figure 4:
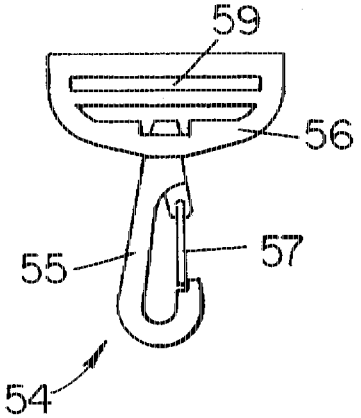
FIG. 4 is a view of a swivel clip according to a preferred embodiment of the invention.

The preferred embodiment of the invention includes the use of a pair of identical wire swivel clips 54, 54'. Swivel clips 54, 54', one of which is depicted in detail in FIG. 4, are similar to those known in the art for providing a releasably clipped connection. Each swivel clip 54 has hook portion 55 which is swivably but permanently connected to a base 56 to allow hook portion 55 to rotate about its own axis. A spring-biased, swinging gate 57 provides for reliable hooked connections. Base 56 of swivel clip 54 is provided with a belt slot 59.

One each of swivel clips 54, 54' is slidably disposed upon first belt 42 and second belt 42', with the hook portions 55, 55' hanging downward, as illustrated in FIG. 6. Belts 42, 42' are passed through the belt slot 59 in each swivel clips 54, 54'.

Figure 5A:
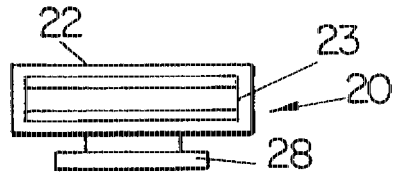
FIG. 5A is a top plan view of the disk hook component according to a preferred embodiment of the invention.
Figure 5B:
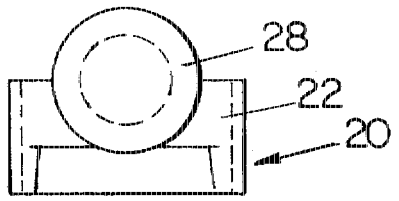
FIG. 5B is a front view of the disk hook component of FIG. 5A.
Figure 5C:
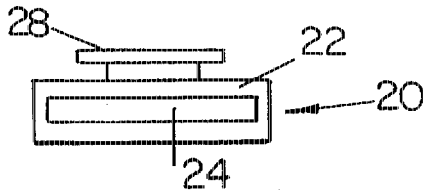
FIG. 5C is a bottom plan view of the disk hook component of FIG. 5A.

The preferred embodiment of the invention employs a pair of identically formed disk hooks 20, 20', one attached to each proximate end 45, 45' of belts 42, 42'. A detailed view of a disk hook 20 is provided by FIGS. 5A–C and 6B. Description of one disk hook 20 and its attachment to belt 42 also describes the other disk hook 20' and its attachment to the second belt 42'. Disk hook 20 preferably is an integral component formed from a sturdy plastic. Disk hook 20 has a pocket body 22 joined to a disk 28. A short, thick, cylindrical stem spaces the disk 28 slightly away from pocket body 22 while connecting the two together, as illustrated in FIGS. 5A and 5C. Pocket body 22 preferably is a small, rectangular, walled box. The top of the box is substantially open, the top opening 23 having a major dimension and a minor dimension, the minor dimension substantially corresponding to twice the thickness of belt 42. The bottom of the box has a centrally located bottom slot 24 whose minor dimension substantially corresponds to the thickness of the belt 42.

FIGS. 6 and 6B depict a preferred mode of affixing disk hooks 20, 20' to the proximate ends of belts 42, 42'. The proximate end 45' of a belt 42' is inserted upward through the bottom slot 24 in pocket body 22, and passed upward through the body 22' to emerge through top opening 23'. A length of belt is drawn out the top opening 23'. As most clearly shown in FIG. 6B, the protruding proximate end 45' is doubled back upon itself, and the fold thus created is secured by a "bar tack" (sewing, gluing, or the like). The doubled-over portion of the proximate end 45' is then forcibly inserted back through the top opening 23' into the hollow interior of pocket body 22', as suggested by the directional arrow in FIG. 6B. Because the minor dimension of the bottom slot is too narrow to permit passage of a double-thickness of belt 42', the folded proximate end 45' is discretely, attractively, and securely retained within the hollow interior of pocket body 22', thus prohibiting the disk hook 20 from slipping off the end of the belt 42'.

Strap member 40 thus is almost bilaterally symmetrical about the centrally disposed shoulder pad 50. Absolute symmetry is compromised by the fact that one belt 42, with its attendant folded-over distal end 43 and tri-bar glide 60, is inverted with respect to the other belt 42' and glide 60', as depicted in FIG. 6. FIG. 6 shows the configuration of a nearly complete strap member 40, excepting that the figure illustrates the folded configuration of the proximate ends 45, 45' of the belts 42, 42' prior to their insertion into the pocket bodies 22, 22' of the disk hooks 20, 20'.

As shown in FIGS. 7, 7A, 7B and 8, the strap 40 comprising belts 42, 42' is releasably attachable to the main luggage case 10 by means of a pair or more of disk receptacles 64, 64'. Each disk receptacle 64, 64' is securely and permanently attached to at least two distinct locations upon the case 10, such as to the sides 15 and 16. As shown in FIG. 7, one or more disk receptacles 64, 64'" is attached to each side 16 of case 10; placing more than one receptacle 64, 64'" at differing heights upon a single side 16 permits the attachment height to be adapted to the size of a particular auxiliary item of luggage 30 and/or the adjusted length of the strap 40.

Figure 8:
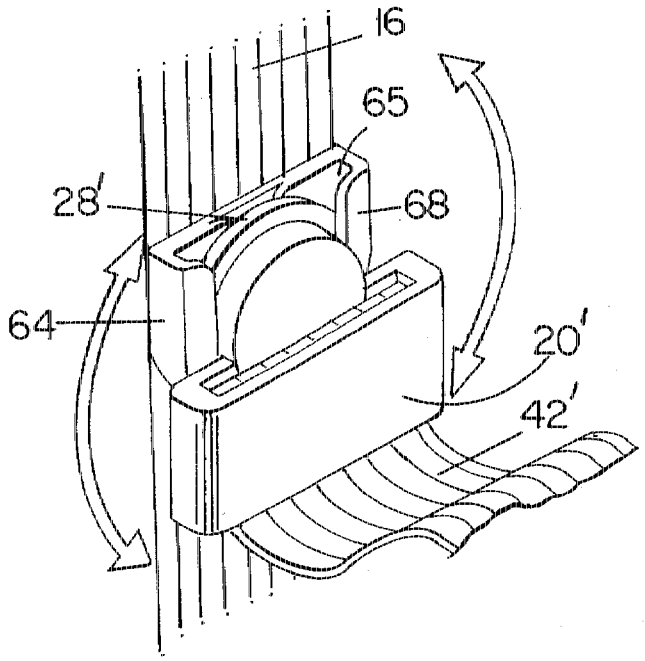
FIG. 8 is a perspective view of the embodiment of FIG. 7A after the auxiliary item of luggage has been attached to the main luggage case according to the invention.
Figure 7A:
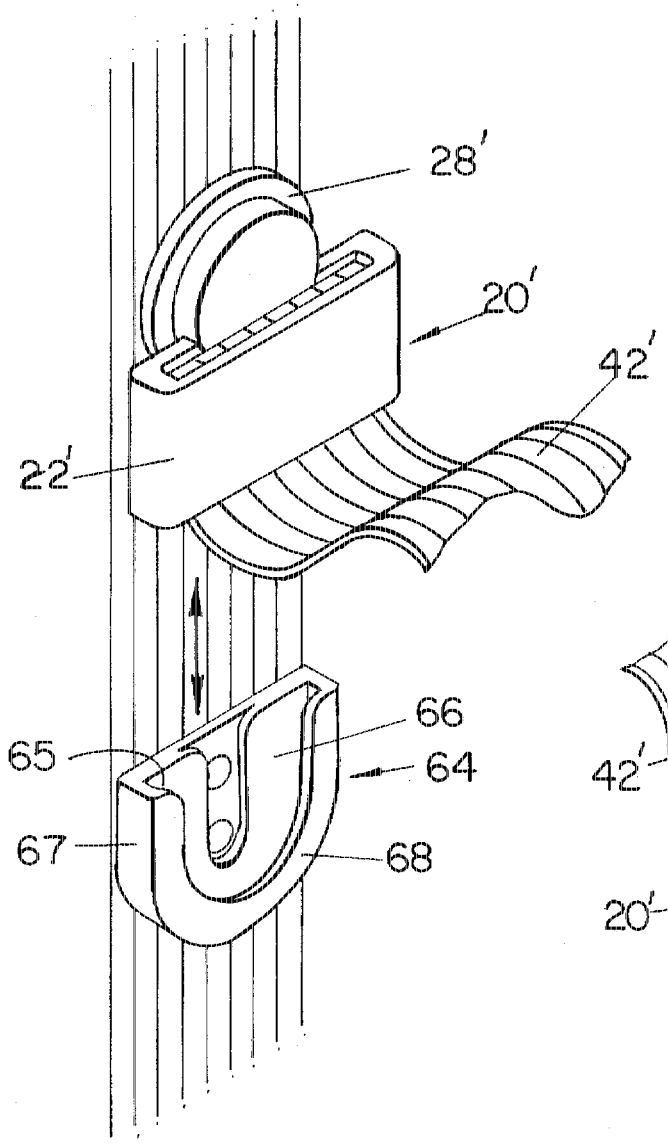
FIG. 7A is an enlarged perspective view of a portion of the embodiment of FIG. 7.
Figure 7B:
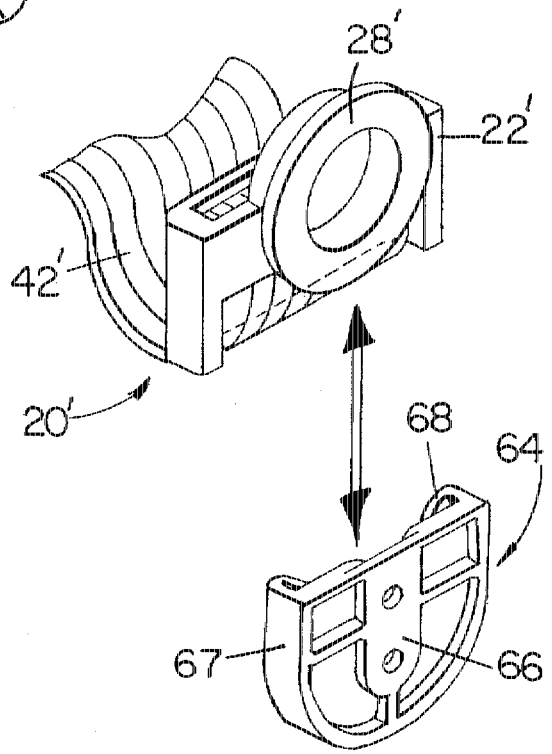
FIG. 7B is a reversed perspective view of the embodiment of FIG. 7.

The particular configuration of a disk receptacle 64 is set forth in FIGS. 7A and 7B. Multiple disk receptacles are identical in configuration. Each disk receptacle 64 consists of a horseshoe-shaped front rim 68 spaced apart from and connected to a back wall 66 by a generally U-shaped side wall 67. As indicated by FIG. 8, back wall 66 and front rim 68 are separated by a distance corresponding generally to the thickness of the disk 28 on the disk hook 22. Further, the catch space 65 contained by back wall 66, side wall 67, and front rim 68 corresponds substantially in shape and size to the shape and size of the disk 28.

Back wall 66 is securely fastened flush against a side 15 or 16 of main case 10, (and preferably to the rigid frame of a soft-sided case) by means of screws, rivets, or the like, placed through holes in back wall 66 provided for that purpose. Each associated pair of disk receptacles 64, 64' are attached to the case 10 at substantially the same distance from the floor or other supporting surface, as indicated by FIG. 3.

To attach the strap 40 to the main case 10, each of disk hooks 20, 20' is coupled with one of corresponding disk receptacles 64, 64' on the sides 15, 16 of the main case 10. As shown by the directional arrows in FIGS. 7A and 7B, each disk 28' is slidably insertable down into the catch space 65 of a corresponding disk receptacle 64 until disk 28' contacts the interior surfaces of side wall 67. As implied by FIGS. 2 and 3, the weight of the auxiliary item of luggage 30, borne through the belts 42, 42' to the disk hooks 20, 20', pulls the disks 28, 28' downward to retain them within the disk receptacles 64, 64'. When it is desired to remove the strap 40 from the main case, the disk hook 20' need merely to be pushed upward to slide the disk 28' up and out from between front rim 68 and back wall 66 to disengage disk hook 20 from disk receptacle 64.

FIG. 8 illustrates an advantage of the preferred embodiment. A disk 28' is maintained within the catch space 65 by the weight of the auxiliary item of luggage, yet as indicated by the directional arrows of FIG. 8, the disk 28' may nevertheless rotate within the receptacle 64, the rotation occurring within a plane substantially parallel to the side 16 of the case 10. This advantage of design permits a disk hook 20 to pivot with respect to the case 10, which allows the connection automatically to adapt to different sizes of auxiliary cases and/or different adjusted lengths of strap 40. Also, such pivoting permits the ends of the belts 42, 42' to rotate (as opposed to a fixed attachment of the belts directly to the case), reducing wear and fatigue in the belts 42, 42' in their high-stress areas near their proximate ends 45, 45'.

The utility of the invention is evident from the foregoing. Strap member 40 preferably is a normal accoutrement of the auxiliary item 10, although swivel clips 54, 54' permit the strap member to be entirely disconnected from auxiliary item, if desired. Swivel clips 54, 54' are snapped onto D-rings 32, 32' to attach strap member 40 to auxiliary item 30. The belts 42, 42' are then slidably moved through the belt slots in swivel clips 54, 54', and the proximate ends 45, 45' of the belts 42, 42' are drawn to the disk receptacles 64, 64'. Disk hooks 20, 20' are then be engaged into disk receptacles 64, 64' to reliably, yet temporarily, secure auxiliary item 30 to main case 10 by means of the strap member 40. Multiple pairs of disk receptacles permit the user to select the elevation of attachment of strap 40 to case 10. Also, the overall length of the strap 40 may then be adjusted, by sliding belts 42, 42' through the glides 60, 60' to properly position the auxiliary item 30 with respect to the main case 10, preferably substantially as shown in FIGS. 1 and 2.

Rivets 48, 48' or the like are secured at locations upon the belts 42, 42' to limit the overall length of the strap member 40. The thicker or "head" sides of rivets 48, 48' project above the surfaces of belts 42, 42' a distance sufficient that the rivets cannot pass through the belt slot 59 in each of the swivel clips 54, 54'. By customizing the location of the rivets 48, 48' along the belts, which location depends upon the size of the particular accompanying auxiliary item 30, the strap 40 is limited in its maximum extension by inability of the rivets to slide through the swivel clips 54, 54'. In the preferred embodiment, the rivets 48, 48' are so located as to provide for a maximum strap length that positions the auxiliary item 30 with respect to the main case 10 as shown in FIG. 1. In this manner, the strap 40 is prevented from slidably extending in length when the cases 10, 30 are wheeled as shown in FIG. 2, thus maintaining the auxiliary item 30 in position against the front 17 of the case 10.

When desired, disk hooks 20, 20' are disengaged from disk receptacles 64, 64' by lifting disks 28, 28' up and out of the catch spaces 65 of the receptacles. The user may then slide the belts 42, 42' through the belt slots in the swivel clips 54, 54' until their movement is arrested by contact of swivel clips 54, 54' with disk hooks 20, 20'. The length of the strap 40 can again be adjusted to the user's preference, and the strap 40 and pad 50 placed over the user's shoulder to carry the auxiliary item 30. Thus, it is noted that an advantage of the invention is that the auxiliary item 30 is detached from the main case 10 quickly and easily, without any need for the user to operate clips or buckles. The user may simply grab the strap 40, lift it up to pull the disk hooks 20, 20' out of the receptacles, and place the strap over his shoulder to carry the item 30 in the usual manner.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of the patents cited hereinabove are hereby incorporated by reference.

We claim:

1. An apparatus for removably attaching an auxiliary item of luggage to a main luggage case, comprising;

loops connected to the auxiliary item of luggage;

a strap slidably disposed through the loops, said strap comprising:

a first belt and a second belt, overlapping along portions of their respective lengths, each said belt having a distal end and a proximate end;

a first bar glide slidably disposed upon the second belt and attached to the distal end of the first belt;

a second bar glide slidably disposed upon the first belt and attached to the distal end of the second belt; and means for padding a central portion of the strap;

means for temporarily attaching the proximate ends of the belts to the main luggage case at at least two distinct locations; and a pair of means for preventing the proximate ends of the belts from sliding through the loops, each of said preventing means being affixed to a proximate end of one of the belts.

2. The apparatus of claim 1 wherein said means for padding comprises a shoulder pad centrally disposed upon the strap around both the belts.

3. The apparatus of claim 1 wherein said means for temporarily attaching the ends of the belts to the main luggage case comprises:

a receptacle mounted upon the main luggage case at each of the distinct locations;

a pair of hooks, each said hook securely affixed to one of the ends of the strap and releasably engageable with at least one of the receptacles.

4. The apparatus of claim 3 wherein the means for preventing the ends of the belts from sliding through the loops comprises the pair of hooks.

5. The apparatus of claim 3 wherein each of the hooks comprises a disk-shaped element, and wherein each receptacle comprises at least two walls defining a catch space having a shape substantially corresponding to the disk-shaped element.

6. The apparatus of claim 1 wherein each of said loops comprises:

a ring extending from the auxiliary item; and a clip releasably engaged with the ring, said clip defining a belt slot; wherein the strap is slidably disposed through the belt slot.

7. An apparatus for removably attaching an auxiliary item of luggage to a main luggage case, the main case having wheel means upon which the main case can be moved by a user along a supporting surface, at least two opposing sides, and a wheel handle for gripping the main case and moving it along the supporting surface, said apparatus comprising:

a strap comprising:

a pair of belts overlapping along portions of their respective lengths, each said belt having a distal end and a proximate end;

a first bar glide slidably disposed upon the second belt and attached to the distal end of the first belt; and a second bar glide slidably disposed upon the first belt and attached to the distal end of the second belt;

means, slidably disposed upon the strap, for connecting the strap to the auxiliary item of luggage;

at least one receptacle mounted upon each of the two opposing sides of the main case;

a pair of hooks, each said hook securely attached to a proximate end of one of the belts and releasably engageable with at least one of the receptacles.

8. The apparatus of claim 7 further comprising a shoulder pad upon a portion of the strap.

9. The apparatus of claim 8 wherein the shoulder pad is slidably disposed upon said overlapping portions.

10. The apparatus of claim 8 wherein the means for connecting the strap comprises means for releasably connecting the strap.

11. The apparatus of claim 10 wherein the means for releasably connecting comprises at least one swivel clip comprising:

a base defining a belt slot; and a hook portion rotatably connected to the base.

12. The apparatus of claim 11 further comprising a pair of swivel clips wherein each swivel hook is disposed upon the strap between the shoulder pad and a respective proximate end of a belt, and wherein each of the hooks attached to the proximate ends of the belts comprises a body larger than the dimensions of the belt slot.

13. The apparatus of claim 7 wherein each of said hooks comprises a disk-shaped element.

14. The apparatus of claim 13 wherein each hook further comprises a body defining a walled pocket for receiving an end of the strap.

15. The apparatus of claim 13 wherein each of the receptacles comprises at least two walls defining a catch space having a shape substantially corresponding to the disk-shaped element.

16. A strap apparatus for removably attaching an auxiliary item of luggage to a main luggage case, comprising:

a first belt having a distal end and a proximate end;

a second belt having a distal end and a proximate end;

means for releasably securing the proximate ends of the belts to the main luggage case at at least two distinct locations;

a first bar glide slidably disposed upon the first belt and secured to the distal end of the second belt;

a second bar glide slidably disposed upon the second belt and secured to the distal end of the first belt; and means, slidably disposed upon the belts, for connecting the belts to the auxiliary item of luggage;

wherein the belts parallelly overlap along portions of their lengths adjacent to their respective distal ends.

17. The apparatus of claim 16 wherein the overlapping portions of the belts are disposed between the first bar glide and the second bar glide.

18. The apparatus of claim 17 comprising a shoulder pad slidably disposed around the overlapping portions of the belts.

19. The apparatus of claim 16 wherein the means for connecting the belts to the auxiliary item of luggage comprises means for releasably connecting the belts.

20. The apparatus of claim 19 wherein said means for releasably connecting comprises a first swivel clip slidably disposed upon the first belt between the first bar glide and the proximate end of the first belt, and a second swivel clip slidably disposed upon the second belt between the second bar glide and the proximate end of the second belt.

21. The apparatus of claim 16 wherein the means for releasably securing the proximate ends of the belts to the main luggage case comprise:

at least two receptacles mounted on opposing sides of the main luggage case; and hooks, engageable with said receptacles, affixed to the proximate end of each of the belts.

22. The apparatus of claim 21 wherein each of said hooks comprises:

a body defining a walled pocket for receiving an end of a belt; and a disk-shaped element protruding from the body.

23. The apparatus of claim 22 wherein each of the receptacles comprises at least two walls defining a space having a shape substantially corresponding to the disk-shaped element.

* * * * *